US005131095A

United States Patent [19]

D'Amato

[11] Patent Number: 5,131,095

[45] Date of Patent: Jul. 21, 1992

[54] COMPOUND TAB FOR ARCHERS

[76] Inventor: Philip D'Amato, 339 86th St., Brooklyn, N.Y. 11209-0001

[21] Appl. No.: 565,655

[22] Filed: Aug. 10, 1990

[51] Int. Cl.[5] ..... A41D 13/08

[52] U.S. Cl. ..... 2/21

[58] Field of Search ..... 2/21, 161 A, 16; 294/25

[56] References Cited

U.S. PATENT DOCUMENTS

| | | | |
|---|---|---|---|
| 2,834,018 | 5/1958 | Farmes | 2/161 A |
| 2,974,319 | 3/1961 | Wilson et al. | 2/21 |
| 2,999,243 | 9/1961 | Gross et al. | 2/21 |
| 3,004,532 | 10/1961 | Vance | 2/21 X |
| 3,217,334 | 11/1965 | Albertelli | 2/21 |
| 3,224,009 | 12/1965 | Hoyt, Jr. | 2/21 |
| 3,229,304 | 1/1966 | Brooks | 2/21 |
| 3,608,090 | 9/1971 | Wilson et al. | 2/21 |
| 3,665,911 | 5/1972 | Altier | 2/21 X |

FOREIGN PATENT DOCUMENTS 155582 11/1904 Fed. Rep. of Germany ..... 2/21

*Primary Examiner*—Werner H. Schroeder
*Assistant Examiner*—Sara M. Current
*Attorney, Agent, or Firm*—Notaro & Michalos

[57] ABSTRACT

An archer's tab comprises a one piece blank having a first string facing panel which is connected by a pair of bands at opposite sides of the first panel to second and third finger panels. The finger panels are rotated through 360° to superimpose and connect them to the first panel at connection areas on the panels which are spaced away from a finger tip and string engaging portion of the tab. A thong connected to a hole extending in the connection area of the tab is used to engage around the wrist to help hold the tab to the hand and preclude excessive opening motion of the fingers when the bow string is released.

19 Claims, 3 Drawing Sheets

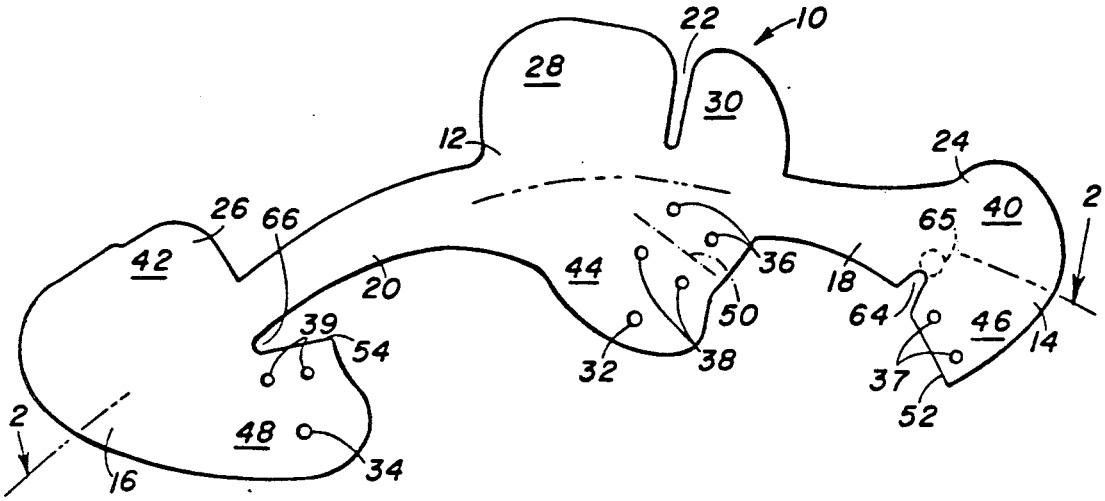
FIG. 1
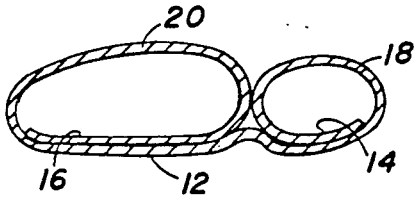
FIG. 2
FIG. 3
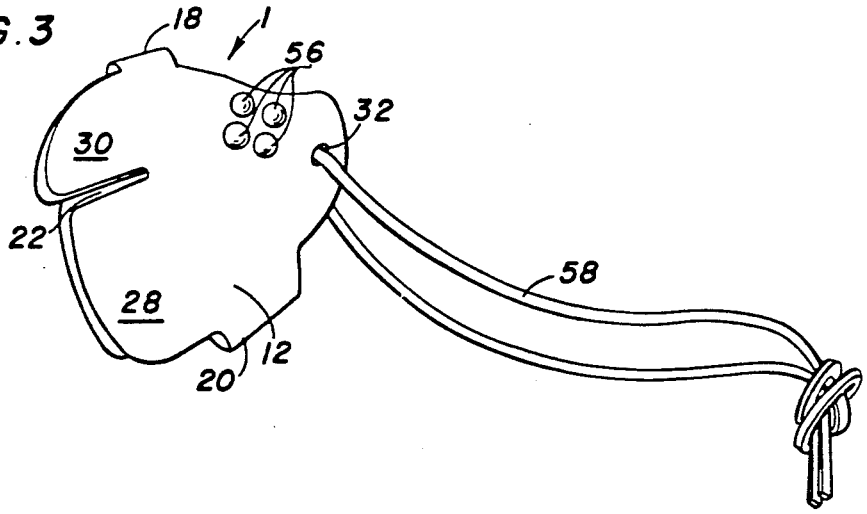

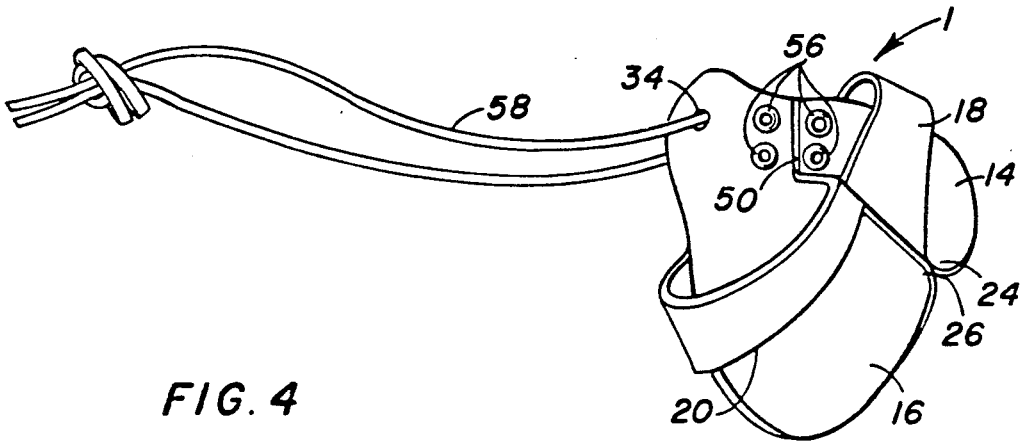
FIG. 4
FIG. 5
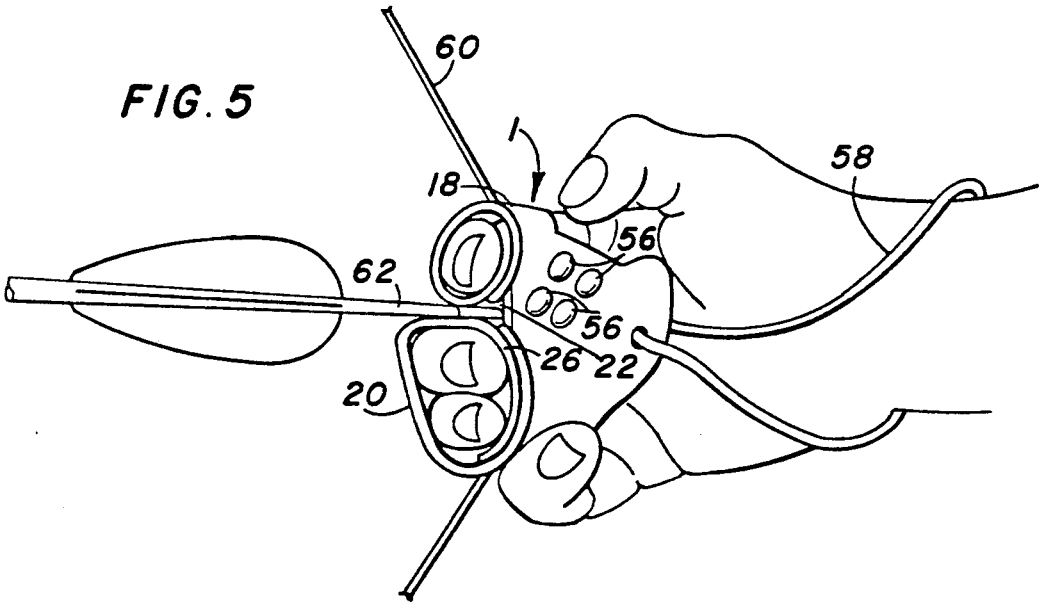

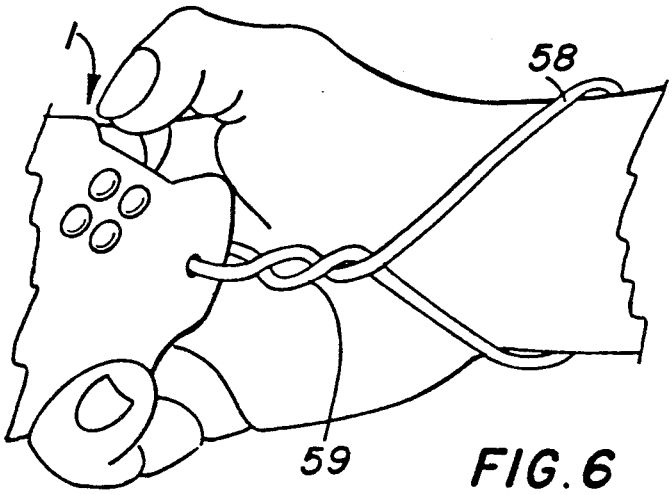
FIG. 6
FIG. 7
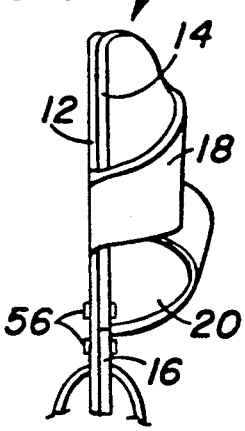
FIG. 8
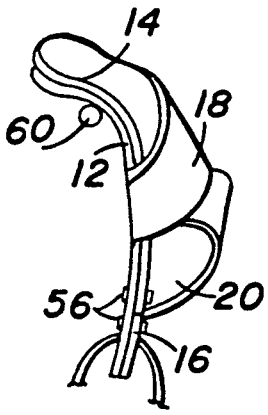

COMPOUND TAB FOR ARCHERS

FIELD AND BACKGROUND OF THE INVENTION

The present invention relates in general to tabs and gloves of the type used to protect the fingers of an archer against pinching and abrasion when used to draw and then release the string of a bow to shoot an arrow from the bow.

It is well known that one of the most critical factors for accuracy in archery is the release, that is the moment when the string is freed so that it can propel the arrow forward. A faulty release can twist and deform the string so that the arrow is cast off target, even if it was correctly aimed. The criticality of the release is increased for compound bows where a let-off in the amount of force needed to retain the drawn string, can be from 50% to 65%. With less force being exerted on the fingers at the point of release, smaller variations and imperfections in the release technique can produce more serious changes in trajectory for the arrow. The release is actually less critical for recurve bows where the pressure at the point of release is greatest.

One technique for reducing the criticality of the release is the use of a mechanical release in the form of a small hand held triggering device which can be used to engage and retract a string. Triggers or push buttons are provided on such mechanical releases which are activated to mechanically release the string. While mechanical releases are generally far more accurate than the use of the fingers, many archers prefer a finger release technique both because it is more traditional and because it is better adapted to so-called "natural shooting" where an archer has become accurate without the use of sights or other mechanical aids.

Because of the great pressure needed to draw the string of a bow however, some protection is needed for the fingers. Such non-mechanical protection is either in the form of a tab or glove which is made of several layers of the same or different material which are sewn together. One example of an archer's tab is disclosed in U.S. Pat. No. 3,608,090 which includes a loop for engagement around the middle finger of the archer's hand for helping retain and position the tab over the fingers. U.S. Pat. No. 2,974,319 discloses another example which includes a strap for engagement around all three string pulling fingers, namely the index finger, the middle finger and the ring finger.

Such tabs also included partitions which are positioned between the index and middle finger to maintain a space between these fingers where the nock or string engaging end of the arrow is held. This avoids the inadvertent placement of pressure on this critical area of the arrow and also protects the fingers against being pinched between the arrow and the string.

An archer's glove is normally constructed of three finger covering portions which cover approximately one half the length of each of the three string drawing fingers. A resilient or elastic panel is connected to the finger covering portions and extends over the back of the hand to a wrist embracing strap or band for holding the glove to the hand. The use of the glove requires that the archer maintain a correct orientation between the three string drawing fingers since the finger covering portions are free to move with respect to each other.

A variety of materials are generally used for the construction of archers' tabs and gloves. This includes deerskin and other leather, Teflon (a trademark of the Du Pont Company) or other synthetic material, calf hair, or a variety of other tough resilient sheet materials.

One common problem experienced by archers using tabs is that the tabs, and in particular the stitches holding the layers together in the tabs, tend to decompose after even moderate use due to sweat and the large forces being exerted on the tabs. The tabs tend to delaminate which renders them useless. Since some use is required before a tab is broken in, delamination often occurs just as the archer is becoming satisfied with the performance of his or her tab.

Similar problems are experienced with gloves.

Another problem experienced both with tabs and gloves, is the tendency for an archer to "pluck" the string by abruptly opening the hand and extending the fingers. This opening motion reduces accuracy and is actually encouraged by gloves which are held to the fingers by a panel extending over the back of the hand.

SUMMARY OF THE INVENTION

The present invention comprises a compound tab which has the advantageous features of a tab, the increased protection of a glove, and some of the attributes of mechanical releases which are characterized by their extreme accuracy.

Another advantage of the present invention is that it is constructed of a blank made of a single layer of material which is folded and connected at a location which is spaced away from the string engaging surface of the tab in such a way that two layers of material are positioned between the fingers and the string, which can curve one around the other in a manner which totally eliminates the delamination and decomposition problems of prior tabs.

The compound tab of the present invention includes a first band for engaging around the index finger and a second band for engaging around the middle and ring fingers, for establishing a positive orientation between the fingers and relationship between the fingers and the string engaging portions of the tab. A thong is also connected to the tab and positioned for engagement along the palm and around the back of the wrist. This has a dual purpose in that during use of the tab, the thong resists "plucking" motion by restricting the opening of the fingers, and when the tab is not in use, the thong keeps the tab handy but out of the way as it is suspended from the wrist. In use on cold winter archer and bow hunting excursions, the inventor has found this feature particularly useful in that the inventor's shooting hand can be kept in the pocket (gloves are normally not appropriate for the shooting hand) while the tab dangles from the wrist outside the pocket for immediate use if a shooting opportunity occurs.

To shorten the effective length of the thong, the tab can also be rotated one or more times before it is engaged on the hand for twisting the thong.

Accordingly, an object of the present invention is to provide a compound tab which has the simplicity of a conventional tab, which maintains the feeling of the string on the fingers but which also includes many of the advantageous characteristics of a mechanical release.

A further object of the invention is to provide a tab with a wrist thong which facilitates the positive positioning and alignment of the fingers, string and arrow and which also avoids over movement of the fingers to produce a consistent, measured mechanical like release of the arrow.

A still further object of the present invention is to provide a sufficient thickness of material between the fingers and the string by rolling the compound tab from a single thickness of material. The rolled form of the tab also serves as a positioning aid for the string and nock end of the arrow, in its relationship with the tab.

Another object of the present invention is to provide a compound tab which is simple in design, rugged in construction and economical to manufacture, and which can withstand the extremes of heavy usage and climate.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which the preferred embodiment of the invention is illustrated.

BRIEF DESCRIPTION OF THE DRAWINGS

In the drawings:

FIG. 1 is a top plan view of a blank constructed in accordance with the invention for making the compound tab of the invention;

FIG. 2 is a sectional view taken along line 2—2 of FIG. 1;

FIG. 3 is plan view showing the string side of the tab;

FIG. 4 is a top plan view showing the hand side of the tab;

FIG. 5 is a side elevational view showing the tab used by an archer before the release of an arrow;

FIG. 6 is a partial view similar to FIG. 5 showing how twists can be placed in the thong for reducing its effective length;

FIG. 7 is a top view of the tab before it is engaged with a string; and

FIG. 8 is a view similar to FIG. 7 showing how the tab is deformed when engaged with a drawn bow string.

DESCRIPTION OF THE PREFERRED EMBODIMENT

Referring to the drawings in particular, the invention embodied therein comprises a tab generally designated 1 in FIGS. 3 and 4, for use to protect the fingers of archers.

Tab 1 is constructed of a one piece blank generally designated 10 in FIG. 1 which is advantageously made of a single thickness of strong flexible material such as leather, Teflon, calf hair or other material used for manufacturing conventional archery tabs and gloves.

As shown in FIG. 1, blank 10 comprises a string facing panel 12, an index finger panel 14 connected by a first band 18 to one side of the panel 12 and a double finger panel 16 connected by a second band 20 to an opposite side of panel 12. First band 18 tapers outwardly and widens from the first or panel 12 toward the second or index finger panel 14. Second band 20 widens from the third or double finger panel 16 toward the first or string panel 12.

String panel 12 includes an arrow receiving slot 22 for receiving the nock end of an arrow as shown for example in FIG. 5. The surface of panel 12 visible in FIG. 1 is the surface which is meant to come into contact with the bow string and includes a lower string engaging area 28 which is braced against the string by the index and ring finger, and an upper string engaging area 30, which is braced by the index finger.

A thong receiving hole 32 is provided in panel 12 opposite from the string engaging areas. Panel 12 is also provided with two pairs of rivet holes 36 and 38.

A pair of rivet holes 37 is also provided in panel 14 and a pair of rivet holes 39 is provided in panel 16. Panel 16 also includes a thong hole 34.

Panel 14 includes an arrow engaging area 24 which is at an inside margin of a finger tip area 40 opposite from the portion of panel 14 carrying the rivet holes 37.

In likewise fashion, panel 16 includes an arrow engaging area 26 which is on a side margin of a finger tip area 42 positioned opposite from rivet holes 39 in panel 16.

The rivet holes 36 and 38 in panel 12 are in a connection area 44 opposite from string engaging areas 28 and 30. Panel 14 also includes a connection area 46 for receiving rivet holes 37 and which is bounded by a mating edge 52. Panel 16 has a connection area 48 for the rivet holes 39 which is also bounded by a mating edge 54.

To construct the compound tab of FIGS. 3 and 4, panels 14 and 16 of the blank shown in FIG. 1 are rolled through 360° down and under the panel 12 as oriented in FIG. 1, to produce the cross section shown in FIG. 2. When using leather, the smooth outer surface of the leather would be visible in FIG. 1 with the opposite surface being rough. In FIG. 2, the upper finger engaging surfaces of panel 14 and 16 are rough with the smooth surface of these panels being engaged against the upper rough surface of panel 12. In this way the smooth surface faces the string for producing a smooth accurate release. The rough surface faces the fingers for increasing the positive engagement between the tab and the fingers.

With the finger panels 14 and 16 rolled into position, finger tip areas 40 and 42 are superimposed on upper and lower string engaging areas 30 and 28 respectively, with the arrow engaging areas 24 and 26 flanking opposite sides of arrow slot 22.

Mating edges 52 and 54 on adjacent sides of panels 14 and 16 are also brought together and meet at a mating line 50 shown in FIG. 1 between the pairs of rivet holes 36, 38 on panel 12.

Rivet holes 37 of panel 14 are aligned with rivet holes 36 of panel 12 while rivet holes 39 and 38 are also aligned with each other.

In this arrangement and as best shown in FIG. 4, rivets 56 are installed through the aligned holes to fix the panels to each other in the connection areas of the panels.

For additional security, and as an optional method, adhesive may also be applied between the panels in the areas 44, 46 and 48. No adhesive and no interconnection is intended or desired between the panels in the upper and lower string engaging and finger tip areas 28, 30, 40 and 42. As will be explained later, this permits the panel 12 to slide with respect to the finger tip areas of panels 14 and 16 when the tab engages a string.

With the blank of FIG. 1 assembled into the tab of FIGS. 3 and 4, thong holes 32 and 34 are also aligned and receive a wrist thong or strap 58 which may also be of leather or other strong flexible material.

Thong 58 is used to extend along the palm and around the back of the archer's wrist as shown in FIGS. 5 and 6. The thong helps retain the tab 1 on the archer's hand while also resisting the tendency for the archer to completely open and extend the index, middle and ring fingers after the string 60 of a bow (not shown) is released to fire an arrow 62.

In order to tailor the length of thong 58 to a variety of hand sizes, one or more twists 59 may be placed in the thong, as shown in FIG. 6, by rotating the tab. When not in use, the tab is conveniently released from the fingers and allowed to dangle out of the way on the wrist.

FIG. 5 also illustrates how the tab of the invention securely holds the nock end of arrow 62 between the arrow engaging areas 24 and 26 and in the arrow slot 22. This provides a well centered bracing for the arrow during release.

FIG. 7 shows tab 1 when not engaged with an arrow. In this position, the superimposed panel 12, meant for facing the string, and 14, 16, meant for facing the fingers, are substantially aligned. As shown in FIG. 8, when the tab embraces the drawn string 60, the string engaging and finger tip areas of the panels curl with respect to each other so that the panel 12 actually extends beyond the upper edges of panels 14, 16. This improves the release in that no part of the tab catches onto the string during the critical release operation.

The present invention thus effectively eliminates delamination and deterioration experienced by known sewn tabs. It does this with a simple one piece blank, which is easily manufactured in mass production. The rolling, riveting and optional gluing of the tab portions can also be readily automated. Even if not automated, assembly is so simple that it can be accomplished by semi-skilled labor and does not require the level of skill required for sewing leather.

While it is contemplated that the invention will be supplied in small, medium and large sizes to be manufactured from small, medium and large blanks, some adjustment is possible in a single blank to change the effective length of the finger engaging bands 18 and 20. This may be done by enlarging a band slot 64 which is defined between band 18 and panel 14 and a band slot 66 which is defined between band 20 and panel 16. Enlargement can be accomplished by a simple hole puncher. The supplemental hole is made at the base of either or both band slots 64, 66 and this affectively spreads the panel from its associated band, increasing the effective length of the band. Phantom line 65 in panel 14 illustrates such an optimal modification to the blank.

Other modifications to the invention include changes in shape and reduction in size for any of the string facing panel, index finger panel or double finger panel, as long as at least one layer of material extends to the string engaging area, and the finger panels are connected to the string facing panel by a pair of bands in a one piece blank.

While a specific embodiment of the invention have been shown and described in detail to illustrate the application of the principles of the invention, it will be understood that the invention may be embodied otherwise without departing from such principles.

What is claimed is:

1. An archer's tab comprising:

a first string facing panel having opposite sides and opposite ends;

a second index finger panel overlying and fixed to a portion of said first panel;

a third double finger panel fixed to and overlying a portion of said first panel, said second and third panels each having an adjacent side, said adjacent sides lying adjacent each other over said first panel;

a first band connected between one side of said first panel and one adjacent side of said second panel for engagement around the index finger of an archer;

a second band connected between an opposite side of said first panel and the adjacent side of said third panel for engagement around a middle and ring finger of the archer; and said first, second and third panels and said first and second bands being mad of a single piece of material, said first panel including an arrow slot at one end thereof, for separating a lower string engaging area from an upper string engaging area of said first panel at said one end of said first panel, said first panel including a connection area at the opposite end thereof only, and said second and third panels being connected to said first panel only at said connection area.

2. A tab according to claim 1 wherein each of said second and third panels include an arrow engaging area extending along at least part of the adjacent side, the arrow engaging areas of said second and third panels flanking said arrow slot.

3. A tab according to claim 2 wherein each arrow engaging area of said second and third panels are at one end of said second and third panels, each of said second and third panels having a connection area at an opposite end thereof, said connection areas of said second and third panels being connected to said connection area of said first panel.

4. A tab according to claim 3 wherein each of said first and second panels include a finger tip engaging area adjacent said arrow engaging area, said finger tip areas being over and non-connected to said respective upper and lower string engaging areas of said first panel.

5. A tab according to claim 4 wherein each of said first and second panels include a mating edge extending along part of the adjacent side, said first panel having a mating line, said mating edges extending along said mating line.

6. A tab according to claim 5 including a plurality of rivet holes in the connection area of said first panel and at least one rivet hole in the connection area of each of said second and third panels adjacent said mating edge, each rivet holes of said second and third panels being aligned with said rivet holes of said first panel, and rivet means extending through said aligned rivet holes for connecting said second and third panels to said first panel.

7. A tab according to claim 6 including a thong hole extending through said third panel and said first panel adjacent the connection areas thereof, and thong means extending through said thong hole for engagement around a wrist of an archer.

8. A tab according to claim 1 wherein each of said second and third panels include a mating edge extending along part of the adjacent side, said first panel including a mating line, said mating edges extending along said mating line with said second and third panels being connected to said first panel only in a connection area around said mating line.

9. A tab according to claim 8 wherein said second panel includes a band slot partly separating said second panel from said first band, said band slot being adjacent said mating edge.

10. A tab according to claim 9 wherein said third panel includes a further band slot partly separating said third panel from said second band and being adjacent to said mating line of said third band.

11. A tab according to claim 10 wherein said first band widens from said first panel to said second panel and said second band widens from said third panel to said first panel.

12. A tab according to claim 1 wherein said first band widens from said first panel to said second panel and said second band widens from said third panel to said first panel.

13. A tab according to claim 1 wherein said first, second and third panels and said first and second bands are all constructed by a one piece blank, said second and third panels being rolled through 360° to wrap said respective second and third bands from said opposite sides of said first panel to said adjacent sides of said second and third panels to superimpose and connect said second and third panels to said first panel.

14. A compound tab for archers, comprising:

a string facing panel having opposite sides and opposite ends, said string facing panel having an arrow slot at one end thereof for separating a lower string engaging area from an upper string engaging area of said string facing panel at said one end thereof, said string facing panel having a connection area at an opposite end thereof only;

an index finger panel having a finger tip area for receiving an archer's index finger, and a connection area at an end of said index finger panel opposite from said finger tip area only, said index finger panel having an arrow engaging area adjacent said finger tip area and a mating edge adjacent said connection area;

a double finger panel having a finger tip area for receiving an index and ring finger of an archer, said double finger panel having a connection area opposite from the finger tip area of said double finger panel only, said double finger panel including an arrow engaging area adjacent said finger tip area and a mating edge adjacent said connection area;

a first band connected between one side of said string facing panel and a side of said index finger panel carrying said arrow engaging area and said mating edge of said index finger panel;

a second band connected between an opposite side of said string facing panel and a side of said double finger panel carrying said arrow engaging area and said mating edge of said double finger panel;

said index finger and double finger panels overlying said string facing panel with the arrow engaging areas adjacent each other and flanking opposite sides of said arrow slot, said index and double finger panels being connected to said string facing panel at said connection areas only, with said panels being overlapped but disconnected from each other at said finger tip and string engaging areas.

15. A tab according to claim 14 including a mating line in said connection area of said string facing panel, said mating edges of said index and double finger panels extending along said mating line.

16. A tab according to claim 15 including rivets connecting said finger panels to said string facing panel on opposite sides of said mating line.

17. A tab according to claim 15 including a thong connected to said string facing panel in said connection area thereof.

18. A blank for constructing an archer's tab, comprising:

a one piece member including a first string facing panel having opposite sides and opposite ends, said first panel having an arrow slot at one end thereof and a connection area at an opposite end thereof;

a first band connected to one side of said first panel and extending outwardly from said first panel;

a second band connected to an opposite side of said first panel and extending outwardly from said first panel;

a second index finger panel having opposite sides and opposite ends, one side of said second panel being connected to an outer end of said first band, said second panel having a finger tip engaging area at one end thereof and a connection area at an opposite end thereof; and a third double finger panel having opposite sides and opposite ends, one side of said third panel being connected to an outer end of said second band, said third panel having a finger tip area at one end thereof and a connection area at an opposite end thereof.

19. A blank according to claim 18 wherein said first panel has a lower string engaging area on one side of said arrow slot and an upper string engaging area on an opposite side of said arrow slot, said finger tip areas of said second and third panels being shaped to approximately correspond to the shapes of said lower and upper string engaging areas respectively, each of said second and third panels on a side thereof connected to said bands, having a slot partly separating each band from its respective second and third panel.

* * * * *